US006390195B1

(12) United States Patent
Nguyen et al.

(10) Patent No.: US 6,390,195 B1
(45) Date of Patent: May 21, 2002

(54) METHODS AND COMPOSITIONS FOR FORMING PERMEABLE CEMENT SAND SCREENS IN WELL BORES

(75) Inventors: Philip D. Nguyen; Ronald J. Crook, both of Duncan; Johnny A. Barton, Marlow; David L. Brown, Temple, all of OK (US)

(73) Assignee: Halliburton Energy Service,s Inc., Duncan, OK (US)

( * ) Notice: Subject to any disclaimer, the term of this patent is extended or adjusted under 35 U.S.C. 154(b) by 19 days.

(21) Appl. No.: 09/698,315

(22) Filed: Oct. 27, 2000

Related U.S. Application Data

(63) Continuation-in-part of application No. 09/627,264, filed on Jul. 28, 2000, now Pat. No. 6,202,751.

(51) Int. Cl.[7] ..... E21B 33/138; E21B 43/02

(52) U.S. Cl. ..... 166/276; 166/287; 166/293; 166/296; 166/376

(58) Field of Search ..... 166/276, 287, 166/293, 296, 300, 309, 376; 106/678, 724, 729, 727, 730, 738, 819, 820, 823

(56) References Cited

U.S. PATENT DOCUMENTS

| | | | | |
|---|---|---|---|---|
| 2,135,909 A | | 11/1938 | Monson | |
| 2,187,895 A | | 1/1940 | Sanders | |
| 2,190,989 A | | 2/1940 | Johnston | |
| 2,193,808 A | | 3/1940 | Dieterich | |
| 2,288,557 A | | 6/1942 | Vollmer | |
| 3,044,547 A | | 7/1962 | Jarboe, Jr. | |
| 3,119,448 A | | 1/1964 | Rhoades | |
| 3,368,623 A | | 2/1968 | Carter et al. | |
| 3,605,899 A | | 9/1971 | Tate et al. | 166/300 |
| 3,816,151 A | | 6/1974 | Podlas | 106/194 |
| 3,862,663 A | | 1/1975 | Curtice et al. | 166/276 |
| 4,239,084 A | * | 12/1980 | Sharp et al. | 166/296 |
| 4,335,788 A | * | 6/1982 | Murphey et al. | 166/296 X |
| 5,062,484 A | | 11/1991 | Schroeder, Jr. et al. | 166/278 |
| 5,228,518 A | * | 7/1993 | Wilson et al. | 166/376 X |
| 5,234,055 A | * | 8/1993 | Cornette | 166/296 X |
| 5,339,902 A | | 8/1994 | Harris et al. | 166/293 |
| 5,355,956 A | * | 10/1994 | Restarick | 166/296 |
| 5,363,916 A | | 11/1994 | Himes et al. | 166/276 |
| 5,529,123 A | | 6/1996 | Carpenter et al. | 166/293 |
| 5,842,528 A | * | 12/1998 | Johnson et al. | 166/296 X |
| 6,063,738 A | | 5/2000 | Chatterji et al. | 507/269 |
| 6,202,751 B1 | * | 3/2001 | Chatterji et al. | 166/276 |
| 6,237,688 B1 | * | 5/2001 | Burleson et al. | 166/287 X |
| 6,273,191 B1 | | 8/2001 | Reddy et al. | 166/293 |

FOREIGN PATENT DOCUMENTS

WO WO 91/87797 A1 11/2001

* cited by examiner

*Primary Examiner*—George Suchfield
(74) *Attorney, Agent, or Firm*—Craig W. Roddy; C. Clark Dougherty, Jr.

(57) ABSTRACT

Methods and compositions for forming permeable cement sand screens in well bores are provided. The compositions are basically comprised of a hydraulic cement, a particulate cross-linked gel containing an internal breaker which after time causes the gel to break into a liquid and water present in an amount sufficient to form a slurry.

18 Claims, No Drawings

METHODS AND COMPOSITIONS FOR FORMING PERMEABLE CEMENT SAND SCREENS IN WELL BORES

This Application is a Continuation-In-Part of application Ser. No. 09/627,264 filed on Jul. 28, 2000, now a U.S. Pat. No. 6,202,751.

BACKGROUND OF THE INVENTION

1. Field of the Invention

The present invention provides methods and compositions for forming permeable cement sand screens in well bores to prevent sand from flowing into the well bores with produced hydrocarbons and other fluids.

2. Description of the Prior Art

Oil, gas and water producing wells are often completed in unconsolidated subterranean formations containing loose or incompetent sand which flow into the well bores with produced fluids. The presence of the sand in the produced fluids rapidly erodes metal tubular goods and other production equipment which often substantially increases the costs of operating the wells.

Heretofore, gravel packs have been utilized in wells to prevent the production of formation sand. In gravel packing operations, a pack of gravel, e.g., graded sand, is placed in the annulus between a perforated or slotted liner or screen and the walls of the well bore in the producing interval. The resulting structure provides a barrier to migrating sand from the producing formation while allowing the flow of produced fluids.

While gravel packs successfully prevent the production of sand with formation fluids, they often fail and require replacement due, for example, to the deterioration of the perforated or slotted liner or screen as a result of corrosion or the like. The initial installation of a gravel pack adds considerable expense to the cost of completing a well and the removal and replacement of a failed gravel pack is even more costly.

Thus, there are continuing needs for improved methods of preventing the production of formation sand, fines and the like with produced subterranean formation fluids.

SUMMARY OF THE INVENTION

The present invention provides improved methods and compositions for forming permeable cement sand screens in well bores which meet the needs described above and overcome the deficiencies of the prior art. The methods of the invention are basically comprised of the following steps. A foamed cement composition is prepared comprised of a hydraulic cement, a particulate solid cross-linked gel containing a delayed internal breaker which after time causes the gel to break into a liquid and water present in an amount sufficient to form a slurry. A pipe containing perforations which are sealed by an acid soluble sealant is placed in a well bore whereby it traverses a fluid producing zone therein. Thereafter, the prepared cement composition is placed in the annulus between the perforated pipe and the walls of the well bore and the cement composition is allowed to set. The particulate cross-linked gel containing a delayed internal breaker in the set cement composition is next allowed to break whereby vugs and channels are formed in the set cement. An acid is then introduced into the perforated pipe so that the acid dissolves the acid soluble sealant on the pipe, flows through the perforations in the pipe into contact with the set cement composition and dissolves portions of the set cement composition connecting the vugs and channels therein whereby the set cement composition is permeated.

The resulting permeable set cement in the well bore functions as a sand screen, i.e., the permeable cement allows produced fluids to flow into the well bore, but prevents formation sand and the like from flowing therein. Because the permeable cement sand screen fills the portion of the well bore adjacent to a producing interval and bonds to the walls of the well bore, the permeable cement can not be bypassed and does not readily deteriorate.

The compositions of this invention for forming a permeable cement sand screen in a well bore are basically comprised of a hydraulic cement, a particulate cross-linked gel containing a delayed internal breaker which after time causes the gel to break into a liquid and water present in an amount sufficient to form a slurry.

It is, therefore, a general object of the present invention to provide improved methods and compositions for forming permeable cement sand screens in well bores.

Other and further objects, features and advantages of the present invention will be readily apparent to those skilled in the art upon a reading of the description of preferred embodiments which follows.

DESCRIPTION OF PREFERRED EMBODIMENTS

In accordance with the methods of this invention, a permeable cement sand screen is formed in a well bore adjacent to a producing interval or zone so that loose and incompetent sand and fines are prevented from entering the well bore with fluids produced from the interval or zone. The methods are basically comprised of the following steps. A foamed cement composition is prepared comprised of a hydraulic cement, a particulate cross-linked gel containing a delayed internal breaker which after time causes the gel to break into a liquid and water present in an amount sufficient to form a slurry. A pipe, e.g., casing or a liner, containing perforations which are sealed by an acid soluble sealant is placed in the well bore whereby it traverses a producing zone therein. Thereafter, the prepared cement composition is placed in the annulus between the perforated pipe and the walls of the well bore and the cement composition is allowed to set therein whereby the cement composition fills and forms a column in the well bore adjacent to the producing interval or zone and bonds to the walls of the well bore. The particulate cross-linked gel containing a delayed internal breaker in the set cement composition is next allowed to break whereby vugs and channels are formed in the set cement column. An acid is then introduced into the perforated pipe whereby the acid dissolves the acid soluble sealant on the pipe, flows through the perforations in the pipe into contact with the set cement composition and dissolves portions of the set cement composition connecting the vugs and channels therein whereby the set cement composition is permeated throughout its length and width.

After the permeable set cement column has been formed in the well bore, the well is produced and the permeable set cement column functions as a sand screen. That is, produced liquids and gases flow through the permeable set cement column into the well bore, but formation sand and fines in the formation are prevented from passing through the permeable set cement.

While a variety of hydraulic cements can be utilized in the foamed cement composition of this invention, Portland cements or their equivalents are generally preferred. Portland cements of the types defined and described in *API Specification For Materials And Testing For Well Cements*, API Specification 10, Fifth Edition, dated Jul. 1, 1990 of the American Petroleum Institute are particularly suitable. Preferred such API Portland cements include classes A, B, C, G and H, with API classes G and H being more preferred and class H being the most preferred.

While various cross-linked gels and internal breakers can be utilized, a preferred particulate cross-linked gel containing a delayed internal breaker for use in accordance with this invention is comprised of water; a hydratable polymer of hydroxyalkylcellulose grafted with vinyl phosphonic acid; a delayed breaker selected from the group of hemicellulase, encapsulated ammonium persulfate, ammonium persulfate activated with ethanol amines or sodium chlorite; and a cross-linking agent comprised of a Bronsted-Lowry or Lewis base.

The particular delayed internal breaker utilized in the cross-linked gel depends on the temperature in the well bore at the location where the cement composition is placed. If the temperature is in the range of from about 80° F. to about 125° F., hemicellulase is utilized. If the temperature is in the range of from about 80° F. to about 250° F., encapsulated ammonium persulfate is utilized. If the temperature is in the range of from about 70° F. to about 100° F., ammonium persulfate activated with ethanol amines is used, and if the temperature is in the range of from about 140° F. to about 200° F., sodium chlorite is utilized. The amount of the delayed internal breaker utilized in the cross-linked gel is such that the gel will break into a liquid in a time period which allows the cement composition to be prepared, placed and set prior to when the gel breaks, e.g., a time period in the range of from about 12 to about 24 hours.

The particulate cross-linked gel containing a delayed internal breaker is generally included in the cement composition in an amount in the range of from about 10% to about 30% by weight of cement in the composition, more preferably in an amount of from about 10% to about 20% and most preferably about 20%.

The water in the foamed cement composition can be fresh water or salt water. The term "salt water" is used herein to mean unsaturated salt solutions and saturated salt solutions including brines and seawater. The water is generally present in the cement composition in an amount sufficient to form a slurry of the solids in the cement composition, i.e., an amount in the range of from about 30% to about 70% by weight of cement in the composition.

The above described cement composition can optionally include an acid soluble particulate solid. That is, a particulate solid material which is acid soluble and does not adversely react with the other components of the cement composition can be included therein to provide a greater cement composition permeability when the cement composition is contacted with an acid. Examples of suitable acid soluble particulate solids include, but are not limited to, calcium carbonate, magnesium carbonate and zinc carbonate. Of these, calcium carbonate is preferred. When used, the acid soluble particulate solid is generally included in the cement composition in an amount in the range of from about 2.5% to about 25% by weight of cement in the composition, more preferably in an amount of from about 5% to about 10% and most preferably about 5%.

The cement composition can also optionally include a liquid hydrocarbon solvent soluble particulate solid to provide additional permeability therein when the cement composition is contacted with a liquid hydrocarbon solvent or produced liquid hydrocarbons. Any of a variety of liquid hydrocarbon solvent soluble materials which do not adversely react with the other components in the cement composition can be utilized. Examples of such materials include, but are not limited to, gilsonite, oil soluble resin, naphthalene, polystyrene beads and asphaltene. Of these, particulate gilsonite is the most preferred. When used, the hydrocarbon soluble particulate solid used is generally included in the cement composition in an amount in the range of from about 2.5% to about 25% by weight of cement in the composition, more preferably in an amount of from about 5% to about 10% and most preferably about 10%.

Another component which can optionally be utilized in the cement composition is a mixture of foaming and foam stabilizing surfactants which in small quantities functions to wet the cement during mixing with water and in larger quantities functions as a foam formation enhancer and stabilizer. While various such mixtures of surfactants can be included in the cement composition, a preferred mixture is comprised of an ethoxylated alcohol ether sulfate surfactant of the formula $$H(CH_2)_a(OC_2H_4)_bOSO_3NH_4^+$$

wherein a is an integer in the range of from about 6 to about 10 and b is an integer in the range of from about 3 to about 10; an alkyl or alkene amidopropylbetaine surfactant having the formula $$R—CONHCH_2CH_2CH_2N^+(CH_3)_2CH_2CO_2^-$$

wherein R is a radical selected from the group of decyl, cocoyl, lauryl, cetyl and oleyl; and an alkyl or alkene amidopropyldimethylamine oxide surfactant having the formula $$R—CONHCH_2CH_2CH_2N^+(CH_3)_2O^-$$

wherein R is a radical selected from the group of decyl, cocoyl, lauryl, cetyl and oleyl. The ethoxylated alcohol ether sulfate surfactant is generally present in the mixture in an amount in the range of from about 60 to about 64 parts by weight. The alkyl or alkene amidopropylbetaine surfactant is generally present in the mixture in an amount in the range of from about 30 to about 33 parts by weight, and the alkyl or alkene amidopropyldimethylamine oxide surfactant is generally present in the mixture in an amount in the range of from about 3 to about 10 parts by weight. The mixture can optionally include fresh water in an amount sufficient to dissolve the surfactants whereby it can more easily be combined with a cement slurry.

A particularly preferred surfactant mixture for use in accordance with this invention is comprised of an ethoxylated hexanol ether sulfate surfactant present in an amount of about 63.3 parts by weight of the mixture, a cocoylamidopropyl betaine surfactant present in an amount of about 31.7 parts by weight of the mixture and cocoylamidopropyldimethylamine oxide present in an mount of about 5 parts by weight of the mixture.

When the mixture of surfactants is used as a cement wetting agent, it is included in the cement composition in an amount in the range of from about 0.1% to about 5% by volume of water in the composition, more preferably in an amount of about 1%.

When it is necessary to foam the cement composition such as when the density of the cement composition must be low in order to prevent fracturing of a subterranean formation or zone in which it is placed, the above described mixture of foaming and foam stabilizing surfactants is generally included in the cement composition of this invention in an amount in the range of from about 0.5% to about 5% by volume of water in the composition, more preferably in an amount of about 1%.

The gas utilized for foaming the cement composition can be air or nitrogen, with nitrogen being preferred. The gas is generally present in an amount sufficient to foam the cement composition, i.e., an amount in the range of from about 10% to about 50% by volume of the cement composition.

The acid used for contacting the acid soluble sealant on the pipe and the set cement composition in the well bore can be any of a variety of acids or aqueous acid solutions. Examples of aqueous acid solutions which can be used include, but are not limited to, aqueous hydrochloric acid solutions, aqueous acetic acid solutions and aqueous formic acid solutions. Generally, an aqueous hydrochloric acid solution containing in the range of from about 1% to about 5% by volume hydrochloric acid is preferred with a 2% by volume hydrochloric acid solution being the most preferred.

A variety of liquid hydrocarbon solvents can also be utilized in accordance with this invention to dissolve the liquid hydrocarbon soluble particulate solid when it is included in the set cement composition. While both liquid aliphatic hydrocarbons and mixtures thereof and liquid aromatic hydrocarbons and mixtures thereof can be utilized, liquid aromatic hydrocarbons are preferred. A particularly suitable liquid aromatic hydrocarbon solvent for use in dissolving particulate gilsonite is xylene. As will be understood, the particular acid or aqueous acid solution utilized should be capable of rapidly dissolving the sealant on the pipe, portions of the set cement and the acid soluble particulate solid when it is used. The liquid hydrocarbon solvent used should be capable of rapidly dissolving the particulate liquid hydrocarbon soluble solid when it is used.

When the acid and the liquid hydrocarbon solvent are both utilized, they can contact the cement composition separately or simultaneously. In a preferred technique, an aqueous acid solution and a liquid hydrocarbon solvent are emulsified, and the emulsion is pumped into contact with the sealant on the pipe and cement composition in the well bore in a quantity and for a time period sufficient to dissolve at least major portions of the dissolvable particulate solid materials in the cement composition.

The perforated pipe utilized in accordance with this invention can be casing or a liner of a length which spans the producing interval or zone in which a permeable cement sand screen of this invention is to be formed. The perforations in the pipe should cover the length of the producing interval or zone and the number and spacing of the perforations are determined using conventional techniques based on the production rate of the well and other factors.

The perforations in the pipe can include screens, filter plates or the like attached in or over the perforations, and the above mentioned acid soluble sealant is placed on the pipe and over the perforations whereby the perforations are sealed. As will be understood by those skilled in the art, the perforations must be sealed so that the cement composition can be pumped downwardly or otherwise through the pipe to the open end thereof and then upwardly or otherwise into the annulus between the pipe and the walls of the producing zone in the well bore.

The sealant for sealing the perforations can be any of a variety of acid soluble sealants such as magnesium oxychloride cement or a mixture of magnesium oxide, magnesium chloride and calcium carbonate.

As described above, the acid utilized to dissolve the sealant on the pipe and other acid soluble materials can be any of a variety of acids or aqueous acid solutions with a 1% to 5% by volume aqueous hydrochloric acid solution being preferred. In a presently preferred technique, the acid is introduced into the pipe by way of a coiled tubing while slowly withdrawing the coiled tubing from the bottom of the pipe to the top to thereby distribute live acid over the length of the pipe.

A preferred method of this invention for forming a permeable cement sand screen in a well bore adjacent to a fluid producing zone therein is comprised of the steps of: (a) preparing a cement composition comprised of a hydraulic cement, a particulate cross-linked gel containing an internal breaker which after time causes the gel to break into a liquid and water present in an amount sufficient to form a slurry; (b) placing a pipe containing perforations in the well bore traversing the fluid producing zone, the perforations in the pipe being sealed by an acid soluble sealant; (c) placing the cement composition prepared in step (a) in the annulus between the perforated pipe and the walls of the well bore and allowing the cement composition to set therein; (d) allowing the particulate cross-linked gel containing the internal breaker to break whereby vugs and channels are formed in the set cement composition; and thereafter (e) introducing an acid into the perforated pipe whereby the acid dissolves the acid soluble sealant on the pipe, flows through the perforations in the pipe into contact with the set cement composition and dissolves portions of the set cement composition connecting the vugs and channels therein whereby the set cement is permeated.

Another preferred method of this invention for forming a permeable cement sand screen in a well bore adjacent to a fluid producing zone therein is comprised of the steps of: (a) preparing a cement composition comprised of a hydraulic cement, a particulate cross-linked gel containing an internal breaker which after time causes the gel to break into a liquid, water present in an amount sufficient to form a slurry, a mixture of foaming and foam stabilizing surfactants comprised of an ethoxylated hexanol ether sulfate surfactant present in an amount of about 63.3 parts by weight of the mixture, cocoylamidopropylbetaine surfactant present in an amount of about 31.7 parts by weight of the mixture and cocoylamidopropyldimethylamine oxide present in an amount of about 5 parts by weight of the mixture and nitrogen gas or air present in an amount sufficient to form a foam; (b) placing a pipe containing perforations in the well bore traversing the fluid producing zone, the perforations in the pipe being sealed by an acid soluble sealant; (c) placing the cement composition prepared in step (a) in the annulus between the perforated pipe and the walls of the well bore and allowing the cement composition to set therein; (d) allowing the particulate cross-linked gel containing the internal breaker to break whereby vugs and channels are formed in the set cement composition; and thereafter (e) introducing an acid into the perforated pipe whereby the acid dissolves the acid soluble sealant on the pipe, flows through the perforations in the pipe into contact with the set cement composition and dissolves portions of the set cement composition connecting the vugs and channels and gas bubbles therein whereby the set cement is permeated.

Yet another preferred method of the present invention for forming a permeable cement sand screen in a well bore adjacent to a fluid producing zone therein is comprised of the steps of: (a) preparing a foamed cement composition comprised of Portland Class H cement, an acid soluble particulate solid comprised of calcium carbonate, a liquid hydrocarbon solvent soluble particulate solid comprised of gilsonite, a particulate cross-linked gel containing a delayed internal breaker comprised of water, a hydratable polymer of hydroxyethylcellulose grafted with vinyl phosphonic acid, a delayed breaker capable of breaking the cross-linked gel at a selected temperature and a cross-linking agent comprised of a Bronsted-Lowry or Lewis base, water present in an amount sufficient to form a slurry, a mixture of foaming and foam stabilizing surfactants comprised of an ethoxylated hexanol ether sulfate surfactant, a cocoylamidopropylbetaine surfactant and a cocoylamidopropyldimethylamine oxide and nitrogen gas or air present in an amount sufficient to form a foam; (b) placing a pipe containing perforations in the well bore traversing the fluid producing zone, the perforations in the pipe being sealed by an acid soluble sealant; (c) placing the foamed cement composition prepared in step (a) in the annulus between the perforated pipe and the walls of the well bore and allowing the foamed cement composition to set therein; (d) allowing the particulate cross-linked gel containing an internal breaker to break whereby vugs and channels are formed in the set foamed cement composition; and thereafter (e) introducing an acid and a liquid hydrocarbon solvent into the perforated pipe whereby the acid dissolves the acid soluble sealant on the pipe, the acid and liquid hydrocarbon solvent flows through the perforations in the pipe into contact with the cement composition and dissolve portions of the set cement, the calcium carbonate and the gilsonite whereby the vugs and channels and gas bubbles therein are connected and the set cement is permeated.

A preferred cement composition of this invention for forming a permeable screen in a well bore is comprised of a hydraulic cement; a particulate cross-linked gel containing an internal breaker comprised of water, a hydratable polymer of hydroxyalkylcellulose grafted with vinyl phosphonic acid, a breaker selected from the group consisting of hernicellulase, encapsulated ammonium persulfate, ammonium persulfate activated with ethanol amines or sodium chlorite and a cross-linking agent comprised of a Bronsted-Lowry or Lewis base and water present in an amount to form a slurry.

Another preferred cement composition of this invention for forming a permeable screen in a well bore is comprised of a hydraulic cement; a particulate cross-linked gel containing an internal breaker comprised of water, a hydratable polymer of hydroxyalkylcellulose grafted with vinyl phosphonic acid, a breaker selected from the group of hemicellulase, encapsulated ammonium persulfate, ammonium persulfate activated with ethanol amines or sodium chlorite and a cross-linking agent comprised of a Bronsted-Lowry or Lewis base; water present in an amount sufficient to form a slurry; a mixture of foaming and foam stabilizing surfactants comprised of ethoxylated hexanol ether sulfate surfactant present in an amount of about 63.3 parts by weight of said mixture, cocoylamidopropylbetaine surfactant present in an amount of about 31.7 parts by weight of said mixture and cocoylamidopropyldimethylamine oxide present in an amount of about 5 parts by weight of said mixture; and nitrogen gas or air present in an amount sufficient to form a foam.

Yet another composition of this invention for forming a permeable cement sand screen in a well bore is comprised of Portland class H cement; particulate solid calcium carbonate; particulate solid gilsonite; a particulate cross-linked gel containing a delayed internal breaker comprised of water, a hydratable polymer of hydroxyethylcellulose grafted with vinyl phosphonic acid, a breaker selected from the group of hemicellulase, encapsulated ammonium persulfate, ammonium persulfate activated with ethanol amines or sodium chlorite and a cross-linking agent comprised of magnesium oxide; water present in an amount sufficient to form a slurry; a mixture of foaming and foam stabilizing surfactants comprised of ethoxylated hexanol ether sulfate surfactant present in an amount of about 63.3 parts by weight, a cocoylamidopropylbetaine surfactant present in an amount of about 31.7 parts by weight and a cocoylamidopropyldimethylamine oxide surfactant present in an amount of about 5 parts by weight; and nitrogen gas or air present in an amount sufficient to form a foam.

As mentioned above, the acid utilized for dissolving the calcium carbonate in the above composition is preferably a 1% to 5% by volume aqueous hydrochloric acid solution and the liquid hydrocarbon solvent for dissolving the particulate gilsonite is preferably xylene.

In order to further illustrate the methods and compositions of the present invention, the following examples are given.

EXAMPLE

A cement slurry was prepared as follows. 100 milliliters of 2% by weight potassium chloride brine were placed in a Warring blender and stirred. 250 grams of Portland Class H cement were slowly added to the brine so that a homogeneous slurry was formed. 70 grams of a particulate cross-linked gel comprised of a hydrated polymer of hydroxyalkylcellulose grafted with vinyl phosphonic acid, cross-linked with a Bronstead-Lowry base and containing an encapsulated ammonium persulfate internal breaker were then added to the slurry. Thereafter, 1 milliliter of a mixture of surfactants comprised of 63.3 parts by weight of an ethoxylated hexanol ether sulfate, 31.7 parts by weight of cocoylamidopropyl betaine and 5 parts by weight of cocoylamidopropyldimethylamine oxide was added to the cement slurry. The resulting slightly foamed slurry was then poured into four molds and the molds were cured for 48 hours at 140° F. The cured samples were then each tested for initial permeability, contacted with a hydrochloric acid solution and tested for final permeability. The concentrations of the hydrochloric acid solutions utilized and the results of the permeability tests are set forth in the Table below.

TABLE

Permeability Test Results

| Sample No. | Initial Permeability, Darcies | Hydrochloric Acid Solution Concentration, % by Volume of Solution | Final Permeability, Darcies |
|---|---|---|---|
| 1 | 4.7 | 5 | 42.6 |
| 2 | 16.7 | 5 | 39.2 |
| 3 | 8.2 | 1 | 73.6 |
| 4 | 4.3 | 1 | 86 |

From the Table, it can be seen that the cement compositions and methods of this invention successfully produced permeable cement useful for forming sand screens.

Thus, the present invention is well adapted to carry out the objects and attain the ends vantages mentioned as well as those which are inherent therein. While numerous changes may be made by those skilled in the art, such changes are encompassed within the spirit of this invention as defined by the appended claims.

What is claimed is:

1. A method of forming a permeable cement sand screen in a well bore adjacent to a fluid producing zone therein comprising the steps of:

(a) preparing a cement composition comprised of a hydraulic cement, a particulate cross-linked gel containing an internal breaker which after time causes said gel to break into a liquid and water present in an amount sufficient to form a slurry;

(b) placing a pipe containing perforations in said well bore traversing said fluid producing zone, said perforations in said pipe being sealed by an acid soluble sealant;

(c) placing said cement composition prepared in step (a) in the annulus between said perforated pipe and the walls of said well bore and allowing said cement composition to set therein;

(d) allowing said particulate cross-linked gel containing said internal breaker to break whereby vugs and channels are formed in said set cement composition; and thereafter (e) introducing an acid into said perforated pipe whereby said acid dissolves said acid soluble sealant on said pipe, flows through said perforations in said pipe into contact with said set cement composition and dissolves portions of said set cement composition connecting said vugs and channels therein whereby said set cement is permeated.

2. The method of claim 1 wherein said hydraulic cement in said cement composition is Portland cement or the equivalent.

3. The method of claim 1 wherein said particulate cross-linked gel containing an internal breaker in said cement composition is comprised of water, a hydratable polymer of hydroxyalkylcellulose grafted with vinyl phosphonic acid, a breaker selected from the group consisting of hemicellulase, encapsulated ammonium persulfate, ammonium persulfate activated with ethanol amines and sodium chlorite and a cross-linking agent comprised of a Bronsted-Lowry or Lewis base.

4. The method of claim 3 wherein said particulate cross-linked gel containing an internal breaker is present in said cement composition in the range of from about 10% to about 30% by weight of cement in said composition.

5. The method of claim 1 wherein said water in said cement composition is selected from the group consisting of fresh water and salt water.

6. The method of claim 5 wherein said water is present in said cement composition in an amount in the range of from about 30% to about 70% by weight of cement in said composition.

7. The method of claim 1 wherein said cement composition further comprises an acid soluble particulate solid.

8. The method of claim 7 wherein said acid soluble particulate solid is calcium carbonate and is present in said cement composition in an amount in the range of from about 2.5% to about 25% by weight of cement in said composition.

9. The method of claim 1 wherein said cement composition further comprises a liquid hydrocarbon solvent soluble particulate solid.

10. The method of claim 9 wherein said liquid hydrocarbon solvent soluble particulate solid is particulate gilsonite and is present in said cement composition in an amount in the range of from about 2.5% to about 25% by weight of cement in said composition.

11. The method of claim 1 wherein said cement composition further comprises a mixture of foaming and foam stabilizing surfactants.

12. The method of claim 11 wherein said mixture of foaming and foam stabilizing surfactants in said cement composition is comprised of ethoxylated hexanol ether sulfate surfactant present in an amount of about 63.3 parts by weight of said mixture, cocoylamidopropylbetaine surfactant present in an amount of about 31.7 parts by weight of said mixture and cocoylamidopropyldimethylamine oxide present in an amount of about 5 parts by weight of said mixture.

13. The method of claim 12 wherein said mixture of foaming and foam stabilizing surfactants is present in the range of from about 0.1% to about 5% by volume of water in said composition.

14. The method of claim 1 wherein said cement composition further comprises a gas in an amount sufficient to form a foam.

15. The method of claim 14 wherein said gas in said composition is selected from the group consisting of air and nitrogen.

16. The method of claim 1 wherein said acid introduced into said perforated pipe in accordance with step (e) is an aqueous hydrochloric acid solution.

17. The method of claim 8 wherein said acid is an aqueous hydrochloric acid solution.

18. The method of claim 9 wherein said liquid hydrocarbon solvent soluble particulate solid is dissolvable in xylene.

* * * * *